US009622315B2

(12) United States Patent
Datta et al.

(10) Patent No.: US 9,622,315 B2
(45) Date of Patent: Apr. 11, 2017

(54) METHOD AND APPARATUS FOR INCREASING DIMMING RANGE OF SOLID STATE LIGHTING FIXTURES

(71) Applicant: PHILIPS LIGHTING HOLDING B.V., Eindhoven (NL)

(72) Inventors: Michael Datta, Brookline, MA (US); Gregory Campbell, Quincy, MA (US); Mark Rabiner, Belmont, MA (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/245,327

(22) Filed: Aug. 24, 2016

(65) Prior Publication Data

US 2016/0366743 A1 Dec. 15, 2016

Related U.S. Application Data

(62) Division of application No. 13/634,956, filed as application No. PCT/IB2011/050865 on Mar. 1, 2011, now Pat. No. 9,456,486.

(60) Provisional application No. 61/315,229, filed on Mar. 18, 2010.

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01)

(58) Field of Classification Search
CPC H05B 33/0815; H05B 33/0845; H05B 37/02; H05B 33/0851; H05B 33/0842; H05B 33/086; H05B 41/2828; H05B 41/3927; H03K 17/687; H03K 17/74
See application file for complete search history.

(56) References Cited

U.S. PATENT DOCUMENTS

| | | | |
|---|---|---|---|
| 5,847,450 | A | 12/1998 | Fink et al. |
| 6,016,038 | A | 1/2000 | Mueller et al. |
| 6,211,626 | B1 | 4/2001 | Lys et al. |
| 7,256,554 | B2 | 8/2007 | Lys |

(Continued)

FOREIGN PATENT DOCUMENTS

| | | | |
|---|---|---|---|
| EP | 254813 | A2 | 2/1988 |
| JP | 2005267999 | A | 9/2005 |

(Continued)

OTHER PUBLICATIONS

Joep Jacobs et al; "Dimming SSL Lamps", eW Products of Philips Color Kinetics, Dec. 2008, pp. 1-8.

(Continued)

*Primary Examiner* — Douglas W Owens
*Assistant Examiner* — Jianzi Chen

(57) ABSTRACT

A device for controlling levels of light output by a solid state lighting load at low dimming levels includes a bleed circuit connected in parallel with the solid state lighting load. The bleed circuit includes a resistor and a transistor connected in series, the transistor being configured to turn on and off in accordance with a duty cycle of a digital control signal when a dimming level set by a dimmer is less than a predetermined first threshold, decreasing an effective resistance of the bleed circuit as the dimming level decreases.

5 Claims, 5 Drawing Sheets

(56) References Cited

U.S. PATENT DOCUMENTS

| | | | | |
|---|---|---|---|---|
| 2005/0231459 | A1 | 10/2005 | Furukawa | |
| 2009/0160369 | A1 | 6/2009 | Godbole et al. | |
| 2010/0060202 | A1* | 3/2010 | Melanson ..... | H05B 33/0809 315/307 |
| 2011/0012530 | A1* | 1/2011 | Zheng ..... | H05B 33/0815 315/294 |

FOREIGN PATENT DOCUMENTS

| | | | |
|---|---|---|---|
| JP | 2005310998 | A | 11/2005 |
| JP | 4241487 | B2 | 3/2009 |
| JP | 4496812 | B2 | 7/2010 |
| WO | 2009157763 | A2 | 12/2009 |
| WO | 2011117770 | A1 | 9/2011 |
| WO | 2011036588 | A1 | 3/2013 |

OTHER PUBLICATIONS

"8-PIN Flash-based, 8-Bit CMOS Microcontrollers With Nano Watt Technology", Microchip, PIC12F683, Data Sheet, 2004, Microchip Technology Inc.

Joep Jacobs; "Deep Dimming of SSL Lamps", Philips Color Kinetics eW Products, Nov. 13, 2008, pp. 1-9.

* cited by examiner

METHOD AND APPARATUS FOR INCREASING DIMMING RANGE OF SOLID STATE LIGHTING FIXTURES

TECHNICAL FIELD

The present invention is directed generally to control of solid state lighting fixtures. More particularly, various inventive methods and apparatuses disclosed herein relate to selectively increasing dimming ranges of solid state lighting fixtures using bleed circuits.

BACKGROUND

Digital or solid state lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference. LED technology includes line voltage powered white lighting fixtures, such as the ESSENTIALWHITE series, available from Philips Color Kinetics. These fixtures may be dimmable using trailing edge dimmer technology, such as electric low voltage (ELV) type dimmers for 120 VAC line voltages.

Many lighting applications make use of dimmers. Conventional dimmers work well with incandescent (bulb and halogen) lamps. However, problems occur with other types of electronic lamps, including compact fluorescent lamp (CFL), low voltage halogen lamps using electronic transformers and solid state lighting (SSL) lamps, such as LEDs and OLEDs. Low voltage halogen lamps using electronic transformers, in particular, may be dimmed using special dimmers, such as electric low voltage (ELV) type dimmers or resistive-capacitive (RC) dimmers, which work adequately with loads that have a power factor correction (PFC) circuit at the input.

Conventional dimmers typically chop a portion of each waveform of the mains voltage signal and pass the remainder of the waveform to the lighting fixture. A leading edge or forward-phase dimmer chops the leading edge of the voltage signal waveform. A trailing edge or reverse-phase dimmer chops the trailing edge of the voltage signal waveform. Electronic loads, such as LED drivers, typically operate better with trailing edge dimmers.

Incandescent and other conventional resistive lighting devices respond naturally without error to a chopped sine wave produced by a phase chopping dimmer. In contrast, LED and other solid state lighting loads may incur a number of problems when placed on such phase chopping dimmers, such as low end drop out, triac misfiring, minimum load issues, high end flicker, and large steps in light output.

In addition, the minimum light output by a solid state lighting load when the dimmer is at its lowest setting is relatively high. For example, the low dimmer setting light output of an LED can be 15-30 percent of the maximum setting light output, which is an undesirably high light output at the low setting. The high light output is further aggravated by the fact that the human eye response is very sensitive at low light levels, making the light output seem even higher. Also, conventional phase chopping dimmers may have minimum load requirements, so the LED load cannot simply be removed from the circuit. Thus, there is a need for reducing light output by a solid state lighting load when the corresponding dimmer is set to a low setting, while meeting any minimum load requirements of the phase chopping dimmer.

SUMMARY

The present disclosure is directed to inventive methods and devices for reducing light output by a solid state lighting load when a phase angle or dimming level of a dimmer is set at low settings.

Generally, in one aspect, a device for controlling levels of light output by a solid state lighting load at low dimming levels includes a bleed circuit connected in parallel with the solid state lighting load. The bleed circuit includes a resistor and a transistor connected in series, the transistor being configured to turn on and off in accordance with a duty cycle of a digital control signal when a dimming level set by a dimmer is less than a predetermined first threshold, decreasing an effective resistance of the bleed circuit as the dimming level decreases.

In another aspect, a device includes an LED load having a light output responsive to a phase angle of a dimmer, a detection circuit, an open loop power converter and a bleed circuit. The detection circuit is configured to detect the dimmer phase angle and to output a pulse width modulation (PWM) control signal from a PWM output port, the PWM control signal having a duty cycle determined based on the detected dimmer phase angle. The open loop power converter is configured to receive a rectified voltage from the dimmer and to provide an output voltage corresponding to the rectified voltage to the LED load. The bleed circuit is connected in parallel with the LED load, and includes a resistor and a transistor having a gate connected to the PWM output port to receive the PWM control signal. The transistor turns on and off in response to the duty cycle of the PWM control signal, where a percentage of the duty cycle increases as the detected dimmer phase angle decreases below a predetermined low dimming threshold, causing an effective resistance of the bleed circuit to decrease and a bleed current through the bleed circuit to increase as the detected dimmer phase angle decreases.

In yet another aspect, a method is provided for controlling a level of light output by a solid state lighting load controlled by a dimmer, the solid state lighting load being connected in parallel with a bleed circuit. The method includes detecting a phase angle of the dimmer; determining a percentage duty cycle of a digital control signal based on the detected phase angle; and controlling a switch in the parallel bleed circuit using the digital control signal, the switch being opened and closed in response to the percentage duty cycle of the digital control signal to adjust a resistance of the parallel bleed circuit, the resistance of the parallel bleed circuit being inversely proportional to the percentage duty cycle of the digital control signal. Determining the percentage duty cycle includes determining that the percentage duty cycle is zero percent when the detected phase angle is above a predetermined low dimming threshold; and calculating the percentage duty cycle in accordance with a predetermined function when the detected phase angle is below the predetermined low dimming threshold. The predetermined function increases the percentage duty cycle in response to decreases in the detected phase angle.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., LED white lighting fixture) may include a number of dies which respectively emit different spectra of electroluminescence that, in combination, mix to form essentially white light. In another implementation, an LED white lighting fixture may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white light LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, microcontrollers, application specific integrated circuits (ASICs), and field-programmable gate arrays (FPGAs).

In various implementations, a processor and/or controller may be associated with one or more storage media (generically referred to herein as "memory," e.g., volatile and non-volatile computer memory such as random-access memory (RAM), read-only memory (ROM), programmable read-only memory (PROM), electrically programmable read-only memory (EPROM), electrically erasable and programmable read only memory (EEPROM), universal serial bus (USB) drive, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same or similar parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Applicants have recognized and appreciated that it would be beneficial to provide an apparatus and method for lowering the minimum output light level that can be otherwise achieved by an electronic transformer with a solid state lighting load connected to a phase chopping dimmer, particularly while meeting minimum load requirements of the phase chipping dimmer.

Figure 1:
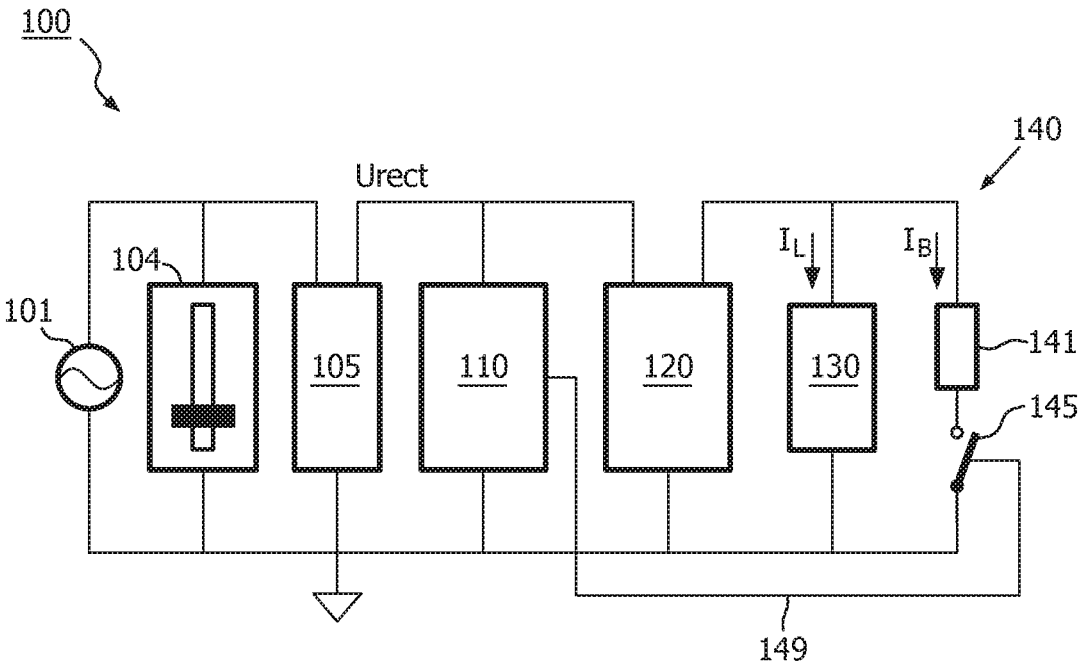
FIG. 1 is a block diagram showing a dimmable lighting system, including a solid state lighting fixture and a bleed circuit, according to a representative embodiment.

FIG. 1 is a block diagram showing a dimmable lighting system, including a solid state lighting fixture and a bleed circuit, according to a representative embodiment.

Referring to FIG. 1, in some embodiments, dimmable lighting system 100 includes dimmer 104 and rectification circuit 105, which provide a (dimmed) rectified voltage Urect from voltage mains 101. The dimmer 104 is a phase chopping dimmer, for example, which provides dimming capability by chopping leading edges (leading edge dimmer) or trailing edges (trailing edge dimmer) of voltage signal waveforms from the voltage mains 101 by operation of its slider. The voltage mains 101 may provide different unrectified input AC line voltages, such as 100 VAC, 120 VAC, 230 VAC and 277 VAC, according to various implementations.

The dimmable lighting system 100 further includes dimmer phase angle detector 110, power converter 120, solid state lighting load 130 and bleed circuit 140. Generally, the power converter 120 receives the rectified voltage Urect from the rectification circuit 105, and outputs a corresponding DC voltage for powering the solid state lighting load 130. The function for converting between the rectified voltage Urect and the DC voltage depends on various factors, including the voltage at the voltage mains 101, properties of the power converter 120, the type and configuration of solid state lighting load 130, and other application and design requirements of various implementations, as would be apparent to one of ordinary skill in the art. Since the power converter 120 receives the rectified voltage Urect following dimming action by the dimmer 104, the DC voltage output by the power converter 120 reflects the dimmer phase angle (i.e., the level of dimming) applied by the dimmer 104.

The bleed circuit 140 is connected in parallel with the solid state lighting load 130 and the power converter 120, and includes resistor 141 and switch 145 connected in series. The effective resistance of the bleed circuit 140 therefore can be controlled through operation of the switch 145, e.g., by the dimmer phase angle detector 110, as discussed below. In turn, the effective resistance of the bleed circuit 140 directly affects the amount of bleed current $I_B$ flowing through the bleed circuit 140 and simultaneously the amount of load current $I_L$ flowing through the parallel solid state lighting load 130, thus controlling the amount of light emitted by the solid state lighting load 130.

The dimmer phase angle detector 110 detects the dimmer phase angle based on the rectified voltage Urect, and outputs a digital control signal via control line 149 to the bleed circuit 140 to control operation of the switch 145. The digital control signal may be a pulse code modulation (PCM) signal, for example. In an embodiment, a high level (e.g., digital "1") of the digital control signal activates or closes the switch 145 and a low level (e.g., digital "0") of the digital control signal deactivates or opens the switch 145. Also, the digital control signal may alternate between high and low levels in accordance with a duty cycle, determined by the dimmer phase angle detector 110 based on the detected phase angle. The duty cycle ranges from 100 percent (e.g., continually at the high level) to zero percent (e.g., continually at the low level), and includes any percentage in between in order to adjust appropriately the effective resistance of the bleed circuit 140 to control the level of light emitted by the solid state lighting load 130. A percentage duty cycle of 70 percent, for example, indicates that a square wave of the digital control signal is at the high level for 70 percent of a wave period and at the low level for 30 percent of the wave period.

For example, when the dimmer phase angle detector 110 operates the switch 145 to remain in the open position (zero percent duty cycle), the effective resistance of the bleed circuit 140 is infinity (open circuit), so the bleed current $I_B$ is zero and the load current $I_L$ is unaffected by the bleed current $I_B$. This operation may be applied in response to high dimming levels (e.g., above a first low dimming threshold, discussed below), such that the current $I_L$ is responsive only to the output of the power converter 120. When the dimmer phase angle detector 110 operates the switch 145 to remain in the closed position (100 percent duty cycle), the effective resistance of the bleed circuit 140 is equal to the relatively low resistance of the resistor 141, so the bleed current $I_B$ is at its highest possible level and the load current $I_L$ is at its lowest possible level (e.g., approaching zero), while still maintaining minimum load requirements, if any. This operation may be applied in response to extremely low dimming levels (e.g., below a second low dimming threshold, discussed below), such that the current $I_L$ is low enough that little to no light is output from the solid state lighting load 130. When the dimmer phase angle detector 110 operates the switch 145 to open and close alternately, the effective resistance of the bleed circuit 140 is between the low resistance of the resistor 141 and infinity, depending on the percentage duty cycle. Therefore, the bleed current $I_B$ and the load current $I_L$ change complementary to one another at the low dimming levels (e.g., between the first low dimming threshold and the second low dimming threshold). Accordingly, the light output by the sold state lighting load 130 likewise continues to dim, even at low dimming levels, which would otherwise have no effect on the light output by conventional systems.

Figure 2:
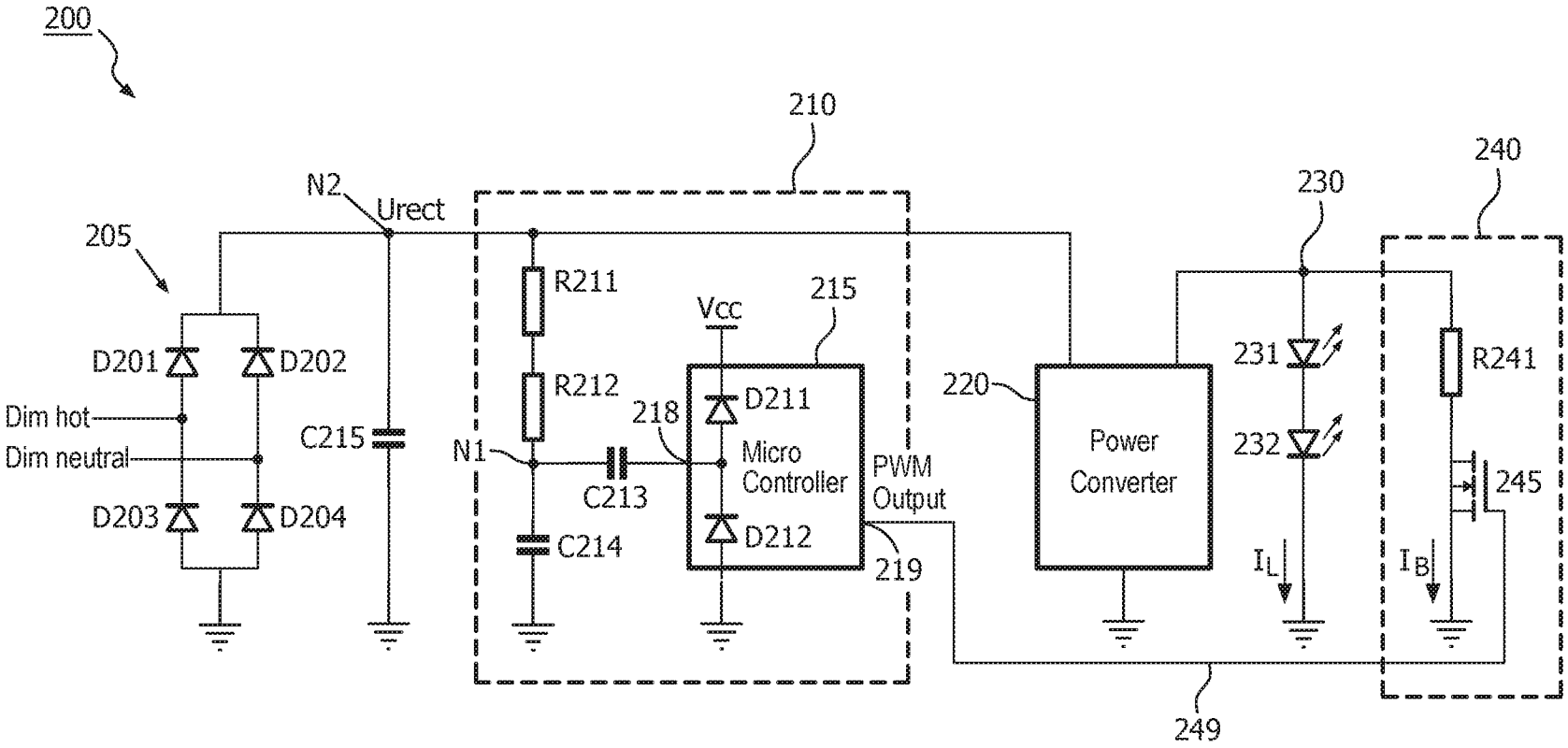
FIG. 2 is a circuit diagram showing a dimming control system, including a solid state lighting fixture and a bleed circuit, according to a representative embodiment.

FIG. 2 is a circuit diagram showing a dimming control system, including a solid state lighting fixture and a bleed circuit, according to a representative embodiment. The general components of FIG. 2 are similar to those of FIG. 1, although more detail is provided with respect to various components, in accordance with an illustrative configuration. Of course, other configurations may be implemented without departing from the scope of the present teachings.

Referring to FIG. 2, in some embodiments, dimming control system 200 includes rectification circuit 205, dimmer phase angle detection circuit 210 (dashed box), power converter 220, LED load 230 and bleed circuit 240 (dashed box). As discussed above with respect to the rectification circuit 105, the rectification circuit 205 is connected to a dimmer (not shown), indicated by the dim hot and dim neutral inputs to receive (dimmed) unrectified voltage from the voltage mains (not shown). In the depicted configuration, the rectification circuit 205 includes four diodes D201-D204 connected between rectified voltage node N2 and ground voltage. The rectified voltage node N2 receives the (dimmed) rectified voltage Urect, and is connected to ground through input filtering capacitor C215 connected in parallel with the rectification circuit 205.

The power converter 220 receives the rectified voltage Urect at the rectified voltage node N2, and converts the rectified voltage Urect to a corresponding DC voltage for powering the LED load 230. The power converter 220 may operate in an open loop or feed-forward fashion, for example, as described by Lys in U.S. Pat. No. 7,256,554, which is hereby incorporated by reference. In various embodiments, the power converter 220 may be an L6562, available from ST Microelectronics, for example, although other types of power converters or other electronic transformers and/or processors may be included without departing from the scope of the present teachings.

The LED load 230 includes a string of LEDs connected in series, indicated by representative LEDs 231 and 232, between an output of the power converter 220 and ground. The amount of load current $I_L$ through the LED load 230 at low dimmer phase angles is determined by the level of resistance and corresponding bleed current $I_B$ of the bleed circuit 240. The level of resistance of the bleed circuit 240 is controlled by the dimmer phase angle detection circuit 210 based on the detected phase angle (level of dimming) of the dimmer, as discussed below.

In the depicted embodiment, the bleed circuit 240 includes transistor 245, which is an illustrative implementation of the switch 145 in FIG. 1, and resistor R241. The transistor 245 may be a field-effect transistor (FET), such as a metal-oxide-semiconductor field-effect transistor (MOS- FET) or a gallium arsenide field-effect transistor (GaAs-FET), for example. Of course, various other types of transistors and/or switches may be implemented without departing from the scope of the present teachings. Assuming for purposes of illustration that the transistor 245 is a MOSFET, for example, the transistor 245 includes a drain connected to the resistor R241, a source connected to ground and a gate connected to a PWM output 219 of microcontroller 215 in the dimmer phase angle detection circuit 210 via control line 249. Accordingly, the transistor 245 receives a PWM control signal from the dimmer phase angle detection circuit 210, and is turned "on" and "off" in response to the corresponding duty cycle, thus controlling the effective resistance of the bleed circuit 240, as discussed above with respect to operation of the switch 145.

The resistor R241 of the bleed circuit 240 has a fixed resistance, the value of which must be balanced between maximizing the amount of load current $I_L$ diverted from the LED load 130 and providing sufficient load to meet minimum load requirements of the phase chopping dimmer, if any. That is, the value of the resistor R241 is small enough that when the duty cycle of the transistor 245 is 100 percent (e.g., the transistor 245 is keep completely "on"), the maximum amount of load current $I_L$ is diverted away from the LED load 130, minimizing light output, while still begin large enough meet minimum load requirements. For example, the resistor R241 may have a value of about 1000 ohms, although the resistance value may vary to provide unique benefits for any particular situation or to meet application specific design requirements of various implementations, as would be apparent to one of ordinary skill in the art.

The dimmer phase angle detector 210 detects the dimmer phase angle based on the rectified voltage Urect, discussed below, and outputs the PWM control signal via control line 249 to the bleed circuit 240 to control operation of the transistor 245. More particularly, in the depicted representative embodiment, the dimmer phase angle detection circuit 210 includes the microcontroller 215, which uses waveforms of the rectified voltage Urect to determine the dimmer phase angle and outputs the PWM control signal through PWM output 219, discussed in detail below. For example, a high level (e.g., digital "1") of the PWM control signal turns "on" the transistor 245 and a low level (e.g., digital "0") of the PWM control signal turns "off" the transistor 245. Therefore, when the PWM control signal is continually high (100 percent duty cycle), the transistor 245 is kept "on," when the PWM control signal is continually low (zero percent duty cycle), the transistor 245 is kept "off," and when the PWM control signal modulates between high and low, the transistor 245 cycles between "on" and "off" at a rate corresponding to the PWM control signal duty cycle.

Figure 3:
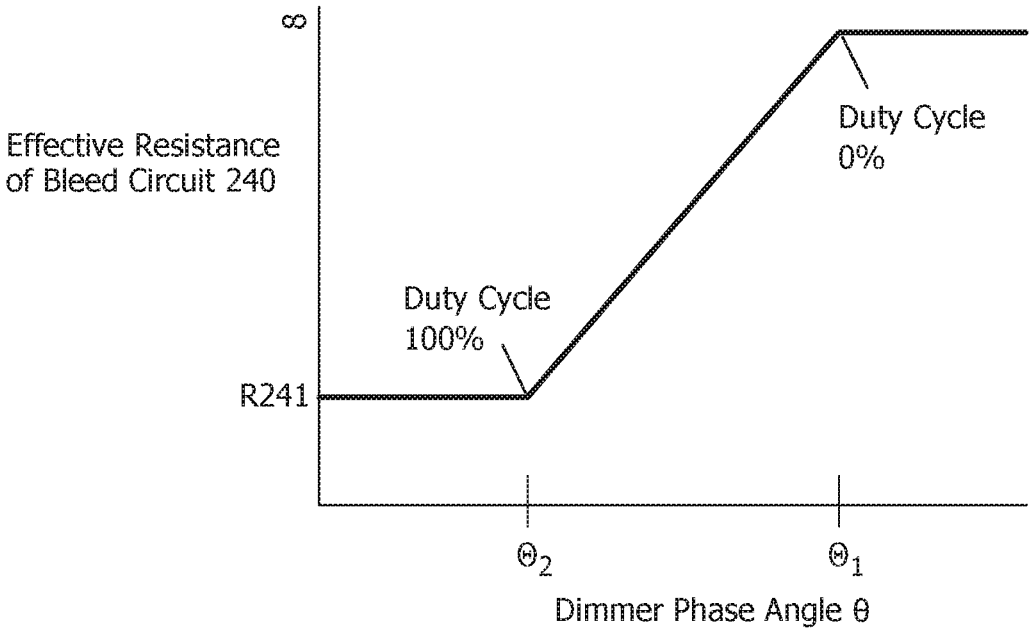
FIG. 3 is a graph showing effective resistance of a bleed circuit with respect to dimmer phase angle, according to a representative embodiment.

FIG. 3 is a graph showing effective resistance of a bleed circuit with respect to dimmer phase angle, according to a representative embodiment.

Referring to FIG. 3, the vertical axis depicts effective resistance of the bleed circuit (e.g., bleed circuit 240) from zero to infinity, and the horizontal axis depicts the dimmer phase angle (e.g., detected by the dimmer phase angle detection circuit 210), increasing from a low or minimum dimmer level.

When the dimmer phase angle detection circuit 210 determines that the dimmer phase angle is above a predetermined first low dimming threshold, indicated by first phase angle $\theta_1$, the duty cycle of the PWM control signal is set to zero percent. In response, the transistor 245 is shut "off," which is its non-conducting state, making the effective resistance of the bleed path 240 infinite. In other words, the bleed current $I_B$ becomes zero, and no load current $I_L$ is diverted from the LED load 230. In various embodiments, the first phase angle $\theta_1$ is the dimmer phase angle at which further reduction of the dimming level at the dimmer would not otherwise reduce the light output by the LED load 230, which may be about 15-30 percent of the maximum setting light output, for example.

When the dimmer phase angle detection circuit 210 determines that the dimmer phase angle is below the first phase angle $\theta_1$, it begins pulse width modulating the transistor 245 by adjusting the percentage duty cycle of the PWM control signal upward from zero percent, in order to lower the effective resistance of the bleed circuit 240 connected in parallel with the LED load 230 and the power converter 220. As discussed above, an increasing portion of the load current $I_L$ is diverted from the LED load 230 and delivered as bleed current $I_B$ to the bleed circuit 240, in response to the effective resistance of the bleed circuit 240 being reduced. In various embodiments where the power converter 220 is running open loop, only the phase chopping dimmer modulates the power delivered to the output of the power converter 220, via the rectification circuit 205. Therefore, connecting the bleed circuit 240 to the output does not change the total amount of power at the output, but rather effectively divides it between the LED load 230 and the bleed circuit 240 in accordance with the percentage duty cycle of the PWM signal. Because the power (and current) is divided into two paths, the LED load 230 receives less power and thus produces a lower level of light.

When the dimmer phase angle detection circuit 210 determines that the dimmer phase angle has been reduced to below a predetermined second low dimming threshold, indicated by second phase angle $\theta_2$, the duty cycle of the PWM control signal is set to 100 percent. In response, the transistor 245 is turned "on," which is its fully conducting state, making the effective resistance of the bleed path 240 essentially equal to the resistance of the resistor R241 (plus negligible amounts of line resistance and resistance from the transistor 245). In other words, the bleed current $I_B$ becomes the maximum value, since a maximum amount of load current $I_L$ is diverted from the LED load 230.

In various embodiments, the second phase angle $\theta_2$ is the dimmer phase angle at which further reduction in resistance of the bleed path 240 would cause the load to drop below the minimum load requirements of the dimmer. Accordingly, the effective resistance of the bleed circuit 240 is constant (e.g., the resistance of resistor R241) below the second phase angle $\theta_2$. Thus, the bleed path 240 draws current even at the very low dimmer phase angles, where the current is delivered to a "dummy load" instead of the LEDs 231 and 232. Of course, the lower the value of R241, the more nearly the load current $I_L$ through the LED load 230 approaches zero, as the transistor 245 is left conducting in response to the 100 percent duty cycle. The value of R141 may be selected to balance the loss in efficacy with the desired low end light level performance of the LED load 230.

Note that the representative curve in FIG. 3 shows linear pulse width modulation from 100 percent to zero percent, indicated by a linear ramp. However, a non-linear ramp may be incorporated, without departing from the scope of the present teachings. For example, in various embodiments, a non-linear function of the PWM control signal may be necessary to create a linear feel of the light output by the LED load 230 corresponding to operation of the dimmer's slider.

Figure 4:
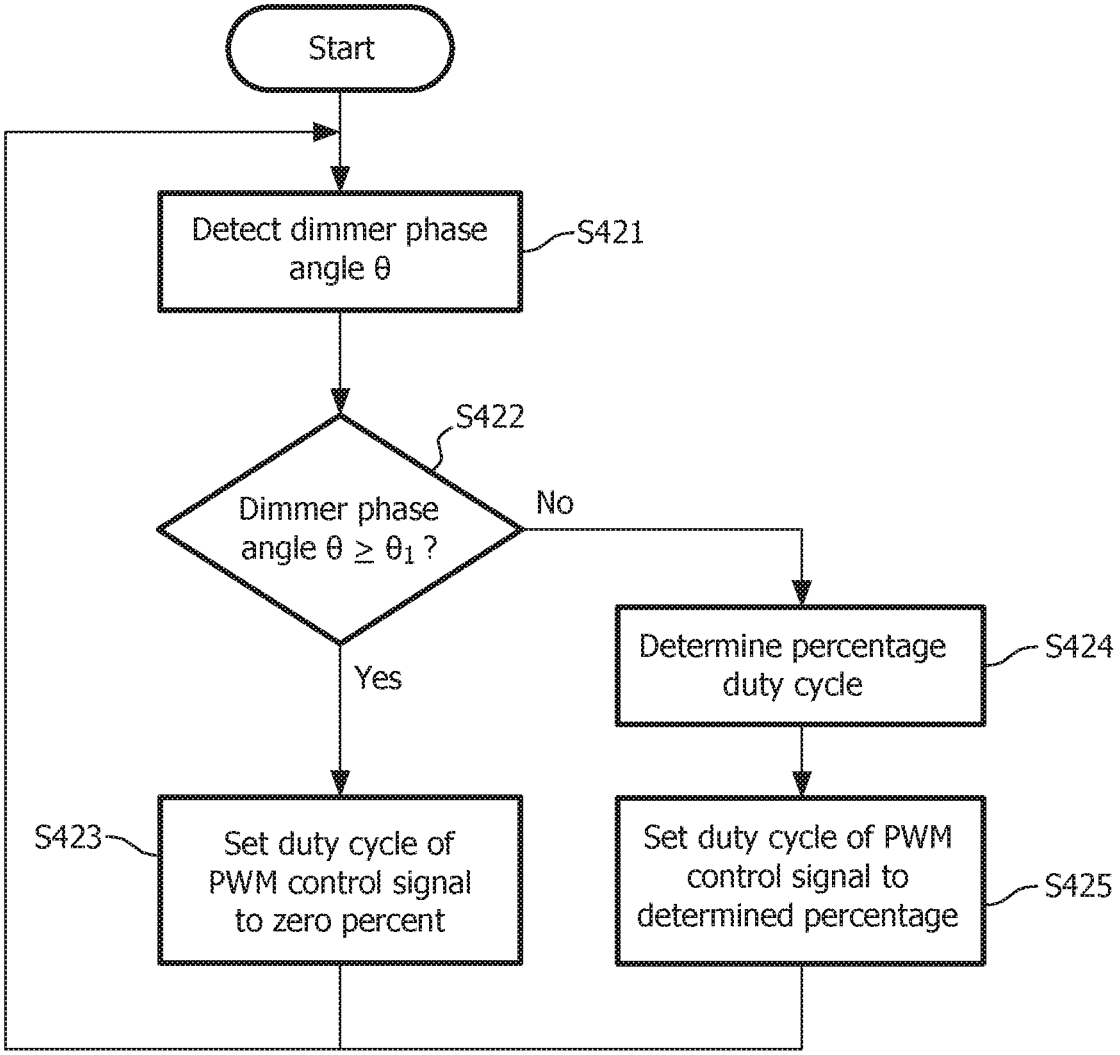
FIG. 4 is a flow diagram showing a process of setting a duty cycle for controlling effective resistance of a bleed circuit, according to a representative embodiment.

FIG. 4 is a flow diagram showing a process of setting a duty cycle for controlling effective resistance of a bleeder circuit, according to a representative embodiment. The process shown in FIG. 4 may be implemented, for example, by the microcontroller 215, although other types of processors and controllers may be used without departing from the scope of the present teachings.

In block S421, the dimmer phase angle θ is determined by the dimmer phase angle detection circuit 210. In block S422, it is determined whether the detected dimmer phase angle is greater than or equal to the first phase angle $\theta_1$, which corresponds to the predetermined first low dimming threshold. When the detected dimmer phase angle is greater than or equal to the first phase angle $\theta_1$ (block S422: Yes), the duty cycle of the PWM control signal is set to zero percent at block S423, which turns "off" the transistor 245. This effectively removes the bleed circuit 240 and enables normal operation of the LED load 230 in response to the dimmer.

When the detected dimmer phase angle is not greater than or equal to the first phase angle $\theta_1$ (block S422: No), the percentage duty cycle of the PWM control signal is determined in block S424. The percentage duty cycle may be calculated, for example, in accordance with a predetermined function of the detected dimmer phase angle, e.g., implemented as a software and/or firmware algorithm executed by the microcontroller 215. The predetermined function may be a linear function which provides linearly increasing percentage duty cycles corresponding to decreasing dimming levels. Alternatively, the predetermined function may be a non-linear function which provides non-linearly increasing percentage duty cycles corresponding to decreasing dimming levels. The duty cycle of the PWM control signal is set to the determined percentage in block S425. The process may then return to block S421 to again determine the dimmer phase angle θ.

In an embodiment, the predetermined function results in the percentage duty cycle being set to 100 percent at the second phase angle $\theta_2$, which corresponds to the predetermined second low dimming threshold. However, in various alternative embodiments, a separate determination may be made following block S422 regarding whether the detected dimmer phase angle is less than or equal to the second phase angle $\theta_2$. When the detected dimmer phase angle is less than or equal to the second phase angle $\theta_2$, the duty cycle of the PWM control signal is set to 100 percent, without having to perform any calculations (e.g., in block S424) relating percentage duty cycle and detected dimmer phase angle.

Referring again to FIG. 2, in the depicted representative embodiment, the dimmer phase angle detection circuit 210 includes the microcontroller 215, which uses waveforms of the rectified voltage Urect to determine the dimmer phase angle. The microcontroller 215 includes digital input pin 218 connected between a top diode D211 and a bottom diode D212. The top diode D211 has an anode connected to the digital input pin 218 and a cathode connected to voltage source Vcc, and the bottom diode 112 has an anode connected to ground and a cathode connected to the digital input pin 218. The microcontroller 215 also includes a digital output, such as PWM output 219.

In various embodiments, the microcontroller 215 may be a PIC12F683, available from Microchip Technology, Inc., for example, although other types of microcontrollers or other processors may be included without departing from the scope of the present teachings. For example, the functionality of the microcontroller 215 may be implemented by one or more processors and/or controllers, and corresponding memory, which may be programmed using software or firmware to perform the various functions, or may be implemented as a combination of dedicated hardware to perform some functions and a processor (e.g., one or more programmed microprocessors and associated circuitry) to perform other functions. Examples of controller components that may be employed in various embodiments include, but are not limited to, conventional microprocessors, microcontrollers, ASICs and FPGAs, as discussed above.

The dimmer phase angle detection circuit 210 further includes various passive electronic components, such as first and second capacitors C213 and C214, and first and second resistors R211 and R212. The first capacitor C213 is connected between the digital input pin 218 of the microcontroller 215 and a detection node N1. The second capacitor C214 is connected between the detection node N1 and ground. The first and second resistors R211 and R212 are connected in series between the rectified voltage node N2 and the detection node N1. In the depicted embodiment, the first capacitor C213 may have a value of about 560 pF and the second capacitor C214 may have a value of about 10 pF, for example. Also, the first resistor R211 may have a value of about 1 megohm and the second resistor R212 may have a value of about 1 megohm, for example. However, the respective values of the first and second capacitors C213 and C214, and the first and second resistors R211 and R212 may vary to provide unique benefits for any particular situation or to meet application specific design requirements of various implementations, as would be apparent to one of ordinary skill in the art.

The (dimmed) rectified voltage Urect is AC coupled to the digital input pin 218 of the microcontroller 215. The first resistor R211 and the second resistor R212 limit the current into the digital input pin 218. When a signal waveform of the rectified voltage Urect goes high, the first capacitor C213 is charged on the rising edge through the first and second resistors R211 and R212. The top diode D211 inside the microcontroller 215 clamps the digital input pin 218 one diode drop above Vcc, for example. On the falling edge of the signal waveform of the rectified voltage Urect, the first capacitor C213 discharges and the digital input pin 218 is clamped to one diode drop below ground by the bottom diode D212. Accordingly, the resulting logic level digital pulse at the digital input pin 218 of the microcontroller 215 closely follows the movement of the chopped rectified voltage Urect, examples of which are shown in FIGS. 5A-5C.

Figure 5A:
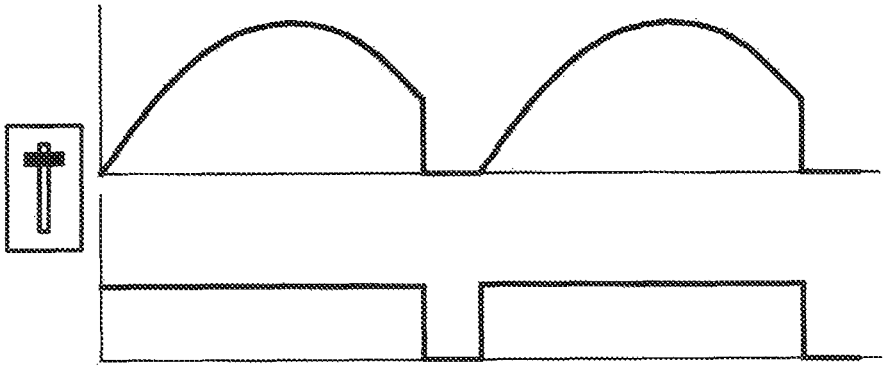
FIGS. 5A-5C show sample waveforms and corresponding digital pulses of a dimmer, according to a representative embodiment.
Figure 5B:
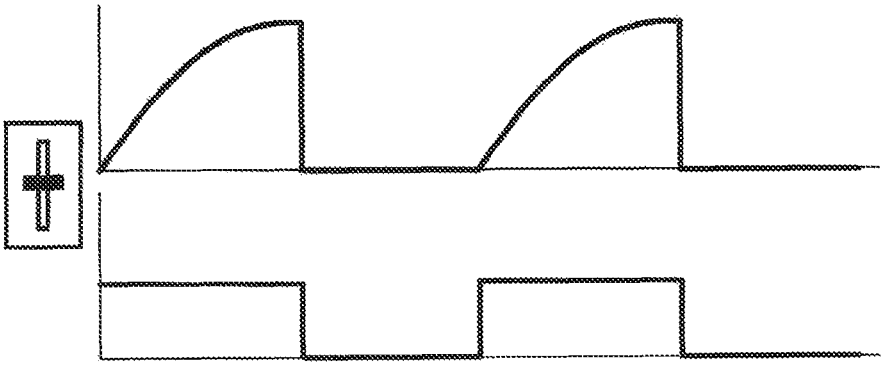
Figure 5C:
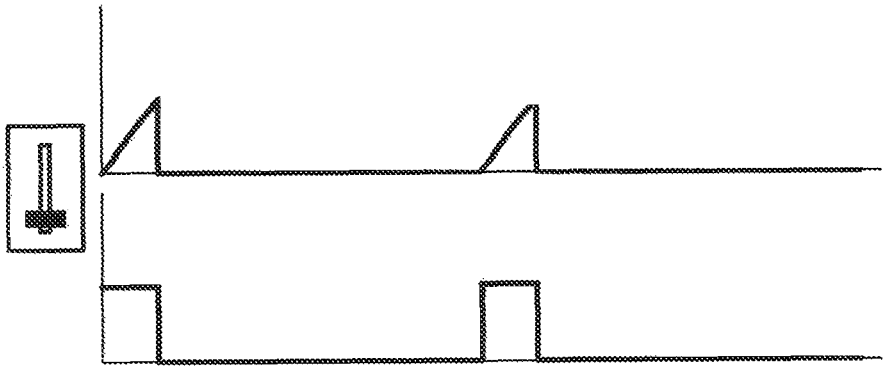

More particularly, FIGS. 5A-5C show sample waveforms and corresponding digital pulses at the digital input pin 218, according to representative embodiments. The top waveforms in each figure depict the chopped rectified voltage Urect, where the amount of chopping reflects the level of dimming. For example, the waveforms may depict a portion of a full 170V (or 340V for E.U.) peak, rectified sine wave that appears at the output of the dimmer. The bottom square waveforms depict the corresponding digital pulses seen at the digital input pin 218 of the microcontroller 215. Notably, the length of each digital pulse corresponds to a chopped waveform, and thus is equal to the amount of time the dimmer's internal switch is "on." By receiving the digital pulses via the digital input pin 218, the microcontroller 215 is able to determine the level to which the dimmer has been set.

FIG. 5A shows sample waveforms of rectified voltage Urect and corresponding digital pulses when the dimmer is at its highest setting, indicated by the top position of the dimmer slider shown next to the waveforms. FIG. 5B shows sample waveforms of rectified voltage Urect and corresponding digital pulses when the dimmer is at a medium setting, indicated by the middle position of the dimmer slider shown next to the waveforms. FIG. 5C shows sample waveforms of rectified voltage Urect and corresponding digital pulses when the dimmer is at its lowest setting, indicated by the bottom position of the dimmer slider shown next to the waveforms.

Figure 6:
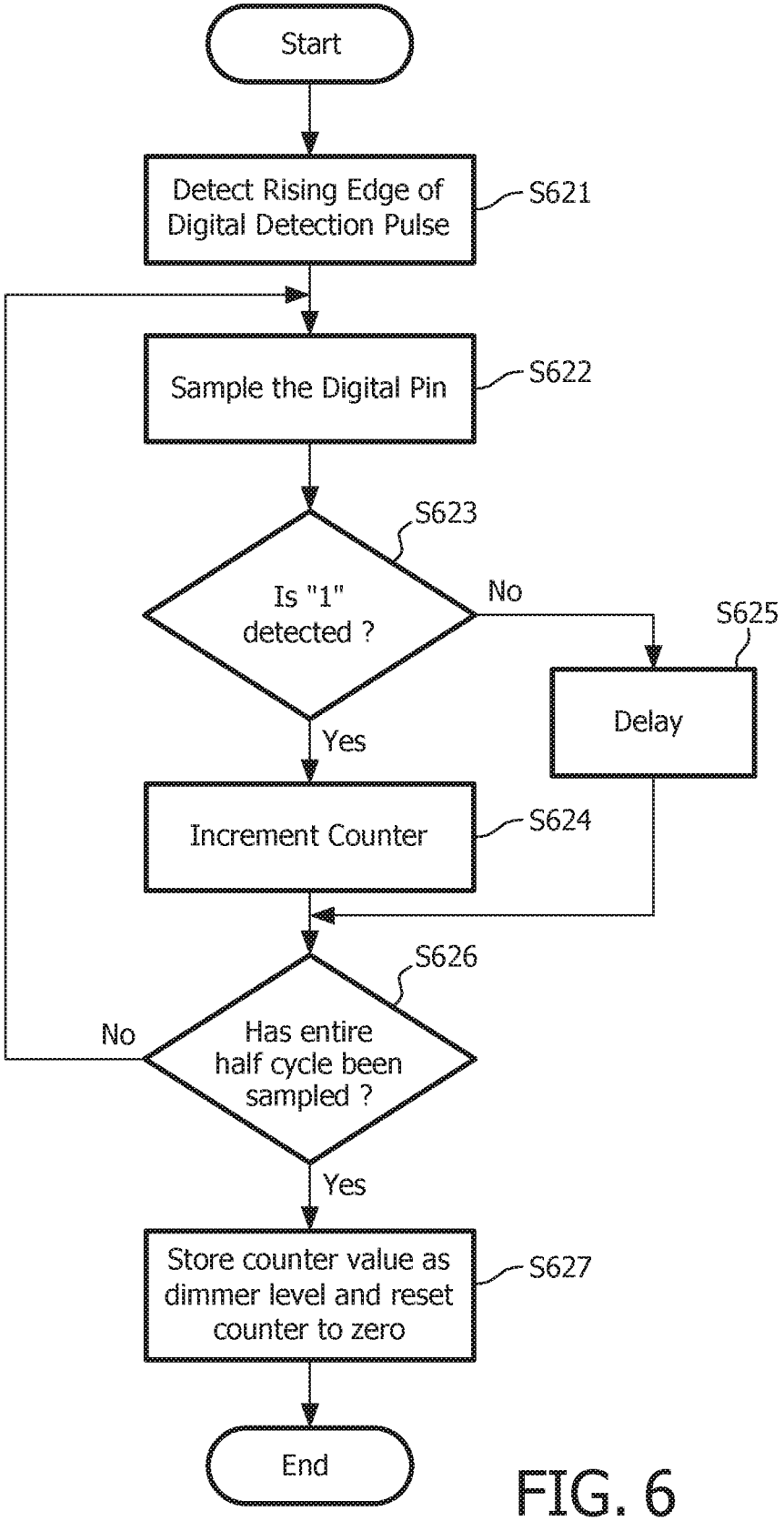
FIG. 6 is a flow diagram showing a process of detecting the phase angle of a dimmer, according to a representative embodiment.

FIG. 6 is a flow diagram showing a process of detecting the dimmer phase angle of a dimmer, according to a representative embodiment. The process may be implemented by firmware and/or software executed by the microcontroller 215 shown in FIG. 2, for example, or more generally by the dimmer phase angle detector 110 shown in FIG. 1.

In block S621 of FIG. 6, a rising edge of a digital pulse of an input signal (e.g., indicated by rising edges of the bottom waveforms in FIGS. 5A-5C) is detected, and sampling at the digital input pin 218 of the microcontroller 215, for example, begins in block S622. In the depicted embodiment, the signal is sampled digitally for a predetermined time equal to just under a mains half cycle. Each time the signal is sampled, it is determined in block S623 whether the sample has a high level (e.g., digital "1") or a low level (e.g., digital "0"). In the depicted embodiment, a comparison is made in block S623 to determine whether the sample is digital "1." When the sample is digital "1" (block S623: Yes), a counter is incremented in block S624, and when the sample is not digital "1" (block S623: No), a small delay is inserted in block S625. The delay is inserted so that the number of clock cycles (e.g., of the microcontroller 215) is equal regardless of whether the sample is determined to be digital "1" or digital "0."

In block S626, it is determined whether the entire mains half cycle has been sampled. When the mains half cycle is not complete (block S626: No), the process returns to block S622 to again sample the signal at the digital input pin 218. When the mains half cycle is complete (block S626: Yes), the sampling stops and the counter value (accumulated in block S624) is identified as the current dimmer phase angle or dimming level, which is stored, e.g., in a memory, examples of which are discussed above. The counter is reset to zero, and the microcontroller 215 waits for the next rising edge to begin sampling again.

For example, it may be assumed that the microcontroller 215 takes 255 samples during a mains half cycle. When the dimmer level is set at the top of its range (e.g., as shown in FIG. 5A), the counter will increment to about 255 in block S624 of FIG. 6. When the dimmer level is set at the bottom of its range (e.g., as shown in FIG. 5C), the counter will increment to only about 10 or 20 in block S624. When the dimmer level is set somewhere in the middle of its range (e.g., as shown in FIG. 5B), the counter will increment to about 128 in block S624. The value of the counter thus provides a quantitative value for the microcontroller 215 to have an accurate indication of the level to which the dimmer has been set or the phase angle of the dimmer. In various embodiments, the dimmer phase angle may be calculated, e.g., by the microcontroller 215, using a predetermined function of the counter value, where the function may vary in order to provide unique benefits for any particular situation or to meet application specific design requirements of various implementations, as would be apparent to one of ordinary skill in the art.

Accordingly, the phase angle of the dimmer may be electronically detected, using minimal passive components and a digital input structure of a microcontroller (or other processor or processing circuit). In an embodiment, the phase angle detection is accomplished using an AC coupling circuit, a microcontroller diode clamped digital input structure and an algorithm (e.g., implemented by firmware, software and/or hardware) executed to determine the dimmer setting level. Additionally, the condition of the dimmer may be measured with minimal component count and taking advantage of the digital input structure of a microcontroller.

In addition, the dimming control system, including the dimmer phase angle detection circuit and the bleed circuit, and the associated algorithm(s) may be used in various situations where it is desired to control dimming at low dimmer phase angles of a phase chopping dimmer, at which dimming would otherwise stop in conventional systems. The dimming control system increases dimming range, and can be used with an electronic transformer with an LED load that is connected to a phase chopping dimmer, especially in situations where the low end dimming level is required to be less than about five percent of the maximum light output, for example.

The dimming control system, according to various embodiments, may be implemented in various lighting products available from Philips Color Kinetics (Burlington, Mass.), including eW Blast PowerCore, eW Burst PowerCore, eW Cove MX PowerCore, and eW PAR 38, and the like. Further, it may be used as a building block of "smart" improvements to various products to make them more dimmer friendly.

In various embodiments, the functionality of the dimmer phase angle detector 110, the dimmer phase angle detection circuit 210 or the microprocessor 215 may be implemented by one or more processing circuits, constructed of any combination of hardware, firmware or software architectures, and may include its own memory (e.g., nonvolatile memory) for storing executable software/firmware executable code that allows it to perform the various functions. For example, the respective functionality may be implemented using ASICs, FPGAs and the like.

Also, in various embodiments, the operating point of the power converter 220 is not changed, e.g., by the microcontroller 215, in order to affect the level of light output by the LED load 230. As a result, the minimum level of output light changes because of the power and current diversion to the bleed circuit 240, and not because of a lowering in the amount of power handled by the power converter 220. This is useful because any minimum load requirement of the phase chopping dimmer may not be met if the power handled by the power converter 220 becomes too low. In various embodiments, switching in a bleed path may be combined with lowering the operating point of the power converter 220, without departing from the scope of the present teachings.

Those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

Reference numerals, if any, are provided in the claims merely for convenience and should not be construed as limiting in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. A device comprising:

a light emitting diode (LED) load having a light output responsive to a phase angle of a dimmer;

a detection circuit configured to detect the dimmer phase angle and to output a pulse width modulation (PWM) control signal from a PWM output port, the PWM control signal having a duty cycle determined based on the detected dimmer phase angle;

an open loop power converter configured to receive a rectified voltage from the dimmer and to provide an output voltage corresponding to the rectified voltage to the LED load; and a bleed circuit connected in parallel with the LED load, the bleed circuit comprising a resistor and a transistor comprising a gate connected to the PWM output port to receive the PWM control signal, the transistor turning on and off in response to the duty cycle of the PWM control signal, wherein a percentage of the duty cycle increases as the detected dimmer phase angle decreases below a predetermined low dimming threshold, causing an effective resistance of the bleed circuit to decrease and a bleed current through the bleed circuit to increase as the detected dimmer phase angle decreases.

2. The device of claim 1, wherein an LED current through the LED load decreases as the bleed current through the bleed circuit increases, reducing the light output of the LED load.

3. The device of claim 2, wherein the duty cycle percentage of the PWM control signal is zero percent when the dimmer phase angle is greater than the predetermined low dimming threshold, such that the transistor is turned off and the bleed current through the bleed circuit is zero.

4. A method for controlling a level of light output by a solid state lighting load controlled by a dimmer, the solid state lighting load being connected in parallel with a bleed circuit, the method comprising:

detecting a phase angle of the dimmer;

determining a percentage duty cycle of a digital control signal based on the detected phase angle; and controlling a switch in the parallel bleed circuit using the digital control signal, the switch being opened and closed in response to the percentage duty cycle of the digital control signal to adjust a resistance of the parallel bleed circuit, the resistance of the parallel bleed circuit being inversely proportional to the percentage duty cycle of the digital control signal, wherein determining the percentage duty cycle comprises:

determining that the percentage duty cycle is zero percent when the detected phase angle is above a predetermined low dimming threshold; and calculating the percentage duty cycle in accordance with a predetermined function when the detected phase angle is below the predetermined low dimming threshold, the predetermined function increasing the percentage duty cycle in response to decreases in the detected phase angle.

5. The method of claim 4, wherein determining the percentage duty cycle further comprises:

determining that the percentage duty cycle is 100 percent when the detected phase angle is below another predetermined dimming threshold, less than the predetermined low dimming threshold, the 100 percent duty cycle causing the switch to remain closed, resulting in the resistance of the parallel bleed circuit having a minimum value.

* * * * *